US008235021B2

(12) United States Patent
Ferrari

(10) Patent No.: US 8,235,021 B2
(45) Date of Patent: Aug. 7, 2012

(54) DEVICE FOR SUPPLYING AN INTERNAL COMBUSTION ENGINE

(75) Inventor: Marco Ferrari, Carpi (IT)

(73) Assignee: Emak S.p.A., Bagnolo in Piano (Reggio Emilia) (IT)

( * ) Notice: Subject to any disclaimer, the term of this patent is extended or adjusted under 35 U.S.C. 154(b) by 255 days.

(21) Appl. No.: 12/812,522

(22) PCT Filed: Jan. 7, 2009

(86) PCT No.: PCT/EP2009/050111

§ 371 (c)(1),
(2), (4) Date: Jul. 12, 2010

(87) PCT Pub. No.: WO2009/087163

PCT Pub. Date: Jul. 16, 2009

(65) Prior Publication Data

US 2010/0288220 A1 Nov. 18, 2010

(30) Foreign Application Priority Data

Jan. 10, 2008 (IT) ..... RE2008A0003

(51) Int. Cl.
*F02M 35/10* (2006.01)
*F02B 77/00* (2006.01)

(52) U.S. Cl. ..... 123/184.54; 123/184.21; 123/198 D

(58) Field of Classification Search ..... 123/184.21, 123/184.53, 184.54, 198 D
See application file for complete search history.

(56) References Cited

U.S. PATENT DOCUMENTS

| | | | | |
|---|---|---|---|---|
| 3,955,545 | A * | 5/1976 | Priegel | 123/531 |
| 4,592,329 | A * | 6/1986 | Yunick | 123/545 |
| 4,759,320 | A | 7/1988 | Fujii et al. | |
| 4,848,281 | A * | 7/1989 | McCord | 123/184.58 |
| 5,375,565 | A * | 12/1994 | Maxson et al. | 123/184.53 |
| 6,167,857 | B1 * | 1/2001 | McCord | 123/184.53 |
| 7,107,962 | B1 | 9/2006 | Spies et al. | |
| 7,128,031 | B2 | 10/2006 | Shirakami et al. | |
| 7,270,103 | B2 | 9/2007 | Kobori | |
| 7,350,495 | B2 * | 4/2008 | Harada | 123/184.24 |
| 7,478,800 | B2 * | 1/2009 | Keller et al. | 261/38 |
| 2006/0191504 | A1 * | 8/2006 | Kobori | 123/184.55 |

FOREIGN PATENT DOCUMENTS

| | | | |
|---|---|---|---|
| EP | 1574683 | A1 | 9/2005 |
| GB | 769041 | A | 2/1957 |
| JP | 57181964 | A * | 11/1982 |
| JP | 11229981 | A1 | 8/1999 |

* cited by examiner

*Primary Examiner* — Noah Kamen
*Assistant Examiner* — Grant Moubry
(74) *Attorney, Agent, or Firm* — Browdy and Neimark, PLLC

(57) ABSTRACT

A device for supplying an internal combustion engine (1), comprising a carburettor (72) and an air filter (71) installed on an air intake line (70), through which the air filtered by the filter (71) is conveyed into the carburettor (72), and an anti-backflow element (8) located in series on the air intake line (70) between the carburettor (72) and the air filter (71), in which the anti-backflow element (8) exhibits an external casing (80) comprising a perimetral band (81) including at least a portion substantially circular in development closed by two side walls (82, 83), such as to internally define at least a compartment (84) in communication with the carburettor (72) through a duct (85) opening in the perimetral band (81) and developing tangentially relative to the circularly developing portion, the compartment (84) also in communication with the air filter (71) through a first duct (86) opening in one of the side walls (82, 83).

12 Claims, 5 Drawing Sheets

DEVICE FOR SUPPLYING AN INTERNAL COMBUSTION ENGINE

TECHNICAL FIELD

The present invention is a device for the supply of an air/fuel mixture to an internal combustion engine, in particular to a two stroke internal combustion engine, of a type destined for installation on portable work tools, for example chainsaws, bush-cutters, portable blowers, and similar.

BACKGROUND ART

As is known, portable power tools are usually provided with a two stroke internal combustion engine, which, in addition to being of minor bulk and weight than a four stroke engine, are also constructionally simpler and consequently more economical.

A two stroke internal combustion engine schematically comprises an external casing, which defines a lower engine compartment serving to contain the crank shaft and above at least a cylinder slidingly housing a piston coupled to the crank shaft. The piston defines a combustion chamber with the cylinder head of variable volume, separated by an airtight seal from the engine compartment.

In two stroke engines the engine compartment is provided with an inlet for the fresh air/fuel mixture, while the combustion chamber is provided with an exhaust outlet for the combustion gases. The engine compartment and combustion chamber are reciprocally connected through a transfer duct formed in the engine bodywork and comprising an inlet opening into the engine compartment and an outlet opening into the combustion chamber.

In proximity of the upper stroke limit, the piston closes the combustion chamber exhaust outlet and the transfer duct outlet, leaving open the inlet opening into the engine compartment; while in proximity to the lower stroke limit, the piston leaves open the combustion chamber exhaust outlet and the transfer duct outlet, closing the inlet opening into the engine compartment. Consequently, the operating cycle of a two stroke internal combustion engine is completed in only two operational strokes of the piston in the cylinder, together corresponding to a single complete rotation of the crank shaft.

The first operational stroke starts with the ignition of the air/fuel mixture in the combustion chamber when the piston it located at the upper limit position, and proceeds as the expansion of the gas pushes the piston towards the lower limit position, compressing the fresh air/fuel mixture contained in the engine compartment. During this downward movement the piston opens first the exhaust outlet, such that the combustion gas starts to exit the combustion chamber, and almost simultaneously the piston opens the transfer duct outlet such that the fresh mixture compressed in the engine compartment begins to flow into the combustion chamber until completely filling the chamber while the exhaust gas exits.

During the subsequent rising stroke, the piston compresses the fresh air/fuel mixture contained in the combustion chamber and, before reaching the upper limit position, opens the inlet through which further fresh air/fuel mixture enters the engine compartment as a consequence of the internal depression generated therein.

When the piston reaches the upper limit position, the spark plug produces a spark which ignites the mixture in the combustion chamber and the cycle repeats.

The fresh air/fuel mixture is supplied to the engine compartment through a device that comprises an air intake line, connected to the inlet and opening externally, along which are installed, in series, an air filter, and a carburettor wherein the filtered air arriving from the filter is mixed with the fuel before entering the engine.

During the rising stroke of the piston, when the inlet opens, the air/fuel mixture present in the intake line is accelerated towards the engine and sucked into the engine compartment by the reduced pressure. When the piston closes the inlet during the subsequent downward stroke the air/fuel mixture, previously accelerated, is blocked by the piston and, as a consequence of the inertia of the air/fuel mixture, a pressure wave is generated in the intake line in the opposite direction, from the motor towards the air filter.

As a consequence of this pressure wave a portion of the air and air/fuel mixture already formed in the carburettor can be transported backwards down the intake line and can reach the air filter, where the fuel can damage or produce deposits on the filter screens, resulting in a rapid and drastic reduction in the filtering capacity of the filter screens.

In order to avoid fuel reaching the air filter, it is known practice to install on the intake line, in series between the air filter and the carburettor, an anti-backflow element consisting substantially of an elbow joint in which the air/fluid mixture passing through the intake line is forced to make a marked change in direction.

In this way, the drops of fuel, travelling back down the intake line as a consequence of the pressure wave, cannot pass the elbow joint because the inertial forces of the direction of flow cause the fuel drops to collide against the internal walls of the elbow joint, consequently collecting inside the elbow joint and then subsequently being expelled during the next cycle.

Despite this solution offering good results, the drops of fuel striking the internal walls of the elbow joint can be fractioned by the impact into a plurality of smaller drops, sometimes sufficiently light to remain suspended in the airflow current and consequently to be carried by the pressure wave beyond the anti-backflow element towards the air filter.

DISCLOSURE OF INVENTION

An aim of the present invention is to improve known devices for the supply of an air/fuel mixture to an internal combustion engine, and in particular a two stroke engine, such as to eliminate the back-flow of fuel towards the air filter. A further aim of the invention is to achieve the above mentioned aim by way of a simple, rational, and relatively inexpensive solution.

These aims are achieved by the characteristics of the invention as described in the independent claim. The dependent claims describe preferred and/or particularly advantageous aspects of the invention.

In particular, a device is provided for the supply of an internal combustion engine, typically two-stroke, comprising a carburettor and an air filter connected in series by at least a intake line, through which the air filtered by the filter is conveyed into the carburettor for mixing with the fuel, and an anti-backflow element located in series along the intake line between the carburettor and the air filter.

In the present invention, the anti-backflow element exhibits an external casing comprising a perimetral band including at least a portion that is substantially circular in development and closed by two opposite side walls, such as to internally define at least a compartment in communication with the carburettor through an outlet duct, opening in the perimetral band and developing tangentially relative to the circularly developing portion, the compartment also in communication with the air filter through at least a first duct opening in one of the side walls.

When a current of air and fuel flows in reverse down the suction line, due to the pressure wave described above, a vortexual motion is induced inside the anti-backflow element, caused principally by the introduction of the air and fuel flow from the first outlet duct tangentially towards the circularly developing portion of the perimetral band. This vortexual motion tends to deviate the flow back towards the carburettor, preventing transported drops of fuel from reaching the air filter. Furthermore, the vortexual motion of the flow tends to project the drops of fuel radially against the internal surface of the perimetral band, thereby separating the drops from the air, the fuel being drawn into the motor by air arriving from the filter during the subsequent intake phase.

The first inlet duct of the anti-backflow element is preferably parallel to the axis of curvature of the circular portion of the perimetral band, such that the first inlet duct is substantially orthogonal to the plane along which the vortexual motion develops, reducing the opportunity for drops of fuel being projected internally and consequently reaching the air filter.

Further, the perimetral band preferably exhibits outward-curving walls in transverse cross-section, and is connected to the side walls of the cover, thereby forming a smooth continuous internal surface which facilitates the development of the vortexual motion and prevents accumulated fuel from remaining trapped.

In a preferred aspect of the invention, the first inlet duct of the anti-backflow element opens into the casing through an aperture positioned eccentrically relative to the axis of curvature of the circular portion of the perimetral band, such that a considerable portion of the perimetral band is laterally closed forming a beaker.

Consequently, the anti-backflow element can be fitted on the internal combustion engine, together with the other components of the supply device, such that when the engine is in the normal operating position, the circular portion of the perimetral band of the external cover is oriented with the axis of curvature horizontal, or orthogonal to the direction of the force of gravity, and the opening of the first duct is located at a height above the axis of curvature.

In this position, the beaker is located at a lower position and consequently serves for the accumulation due to gravity of a considerable quantity of fuel, before onset of a risk of the fuel overflowing through the first inlet duct. It is important to note that the normal operating position of the engine is taken to be the position the engine assumes during normal use of the tool to which it is associated.

In a further preferred aspect of the invention, the internal chamber of the anti-backflow element is also in communication with the air filter through a second access duct opening on the opposite side wall to that of the first access duct, both ducts being preferably equal in size and reciprocally aligned with each other.

In an alternative embodiment of the invention the perimetral band of the external cover consists of two portions of substantially circular development arranged symmetrically relative to a central axis of symmetry, such as to confer the perimetral band a substantially two-lobed profile.

The circular portions are closed by the side walls of the external cover, such as to define two internal compartments, each compartment in communication with the carburettor through an outlet duct opening in the perimetral band and developing tangentially relative to the relevant circularly developing portion, and connected to the air filter through at least a first access duct opening in one of the side walls.

Consequently, a flow of air and fuel running backwards down the intake line forms two vortexual motions inside the anti-backflow element, thereby improving the efficiency of the anti-backflow element while also significantly reducing the overall dimensions.

BRIEF DESCRIPTION OF THE DRAWINGS

Further characteristics and advantages of the invention will better emerge from the detailed description made herein, provided by way of non-limiting example in the accompanying figures of the drawings.

BEST MODE FOR CARRYING OUT THE INVENTION

Figure 1:
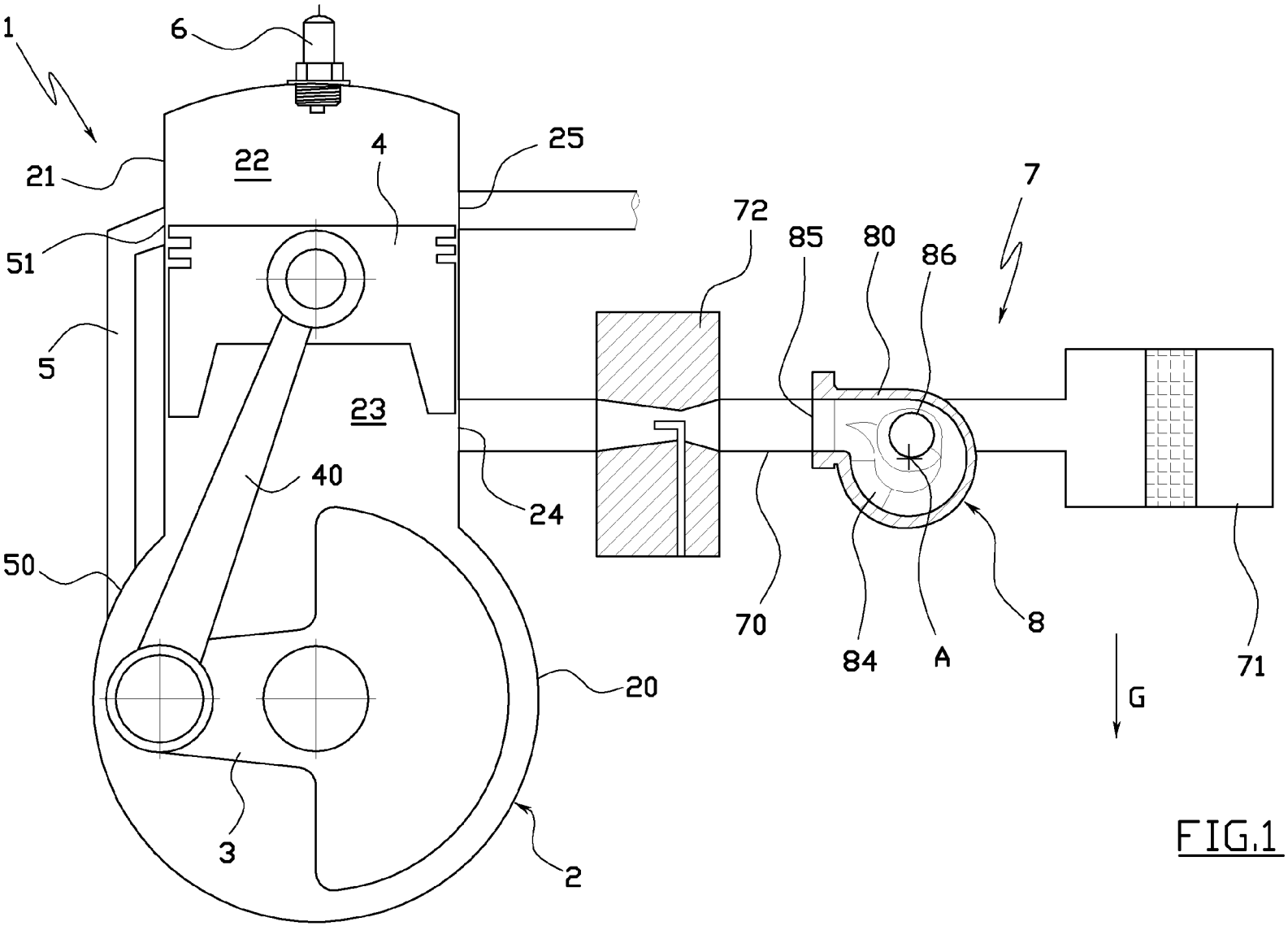
FIG. 1 schematically illustrates a two stroke internal combustion engine fitted with a supply device of a first embodiment of the invention.

FIG. 1 schematically illustrates a typical two stroke internal combustion engine 1, of the type normally installed on portable power tools, such as for example chainsaws, bush-cutters, portable blowers, and similar.

The engine 1 comprises an external cover, globally labelled as 2, defining a lower engine compartment 20 containing a crank shaft 3, and above at least a cylinder 21 slidingly housing a piston 4 connected to the crank shaft 3 by a con rod 40.

The piston 4 defines a combustion chamber 22 with the cylinder head 21, separating, by an airtight seal, the combustion chamber 22 from an underlying compression chamber 23 defined inside the engine compartment 20. The combustion chamber 22 and the compression chamber 23 are both of variable volume, by effect of the sliding of the piston 4 inside the cylinder 21.

The combustion chamber 22 and the compression chamber 23 are reciprocally connected through a transfer duct 5, formed in the body of the engine, which affords an inlet 50 opening into the compression chamber 23, and an outlet 51 opening into the combustion chamber 22.

The compression chamber 23 also exhibits an inlet 24, located at a higher position relative to the inlet 50 of the transfer duct 5, through which the air/fuel mix, typically a petrol/oil mixture, is introduced inside the engine compartment 20.

The combustion chamber 22 also exhibits an outlet 25, located at a height slightly higher relative to the outlet 51 of the transfer duct 5, through which combustion gas is released to the exterior.

A spark plug 6 extends into the combustion chamber 22, fixed to the cylinder head 21 and serving to trigger the spark necessary for igniting the air/fuel mix.

Figure 2:
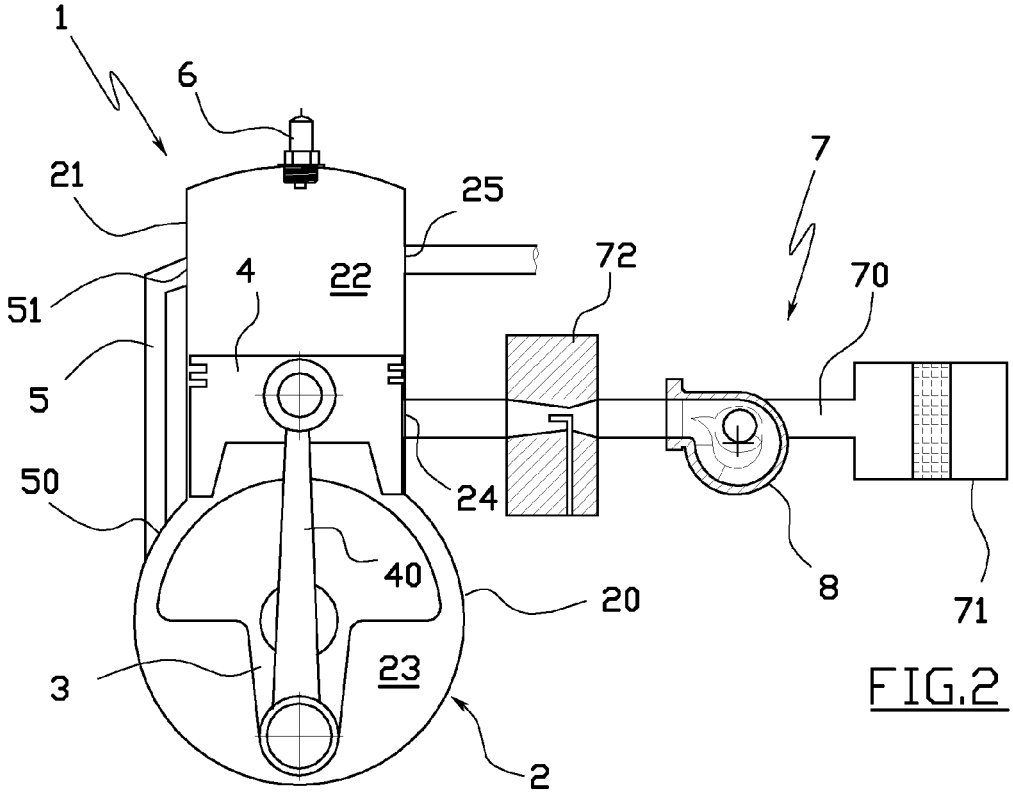
FIGS. 2 and 3 illustrate the engine of FIG. 1 during two distinct stages of the operating cycle.
Figure 3:
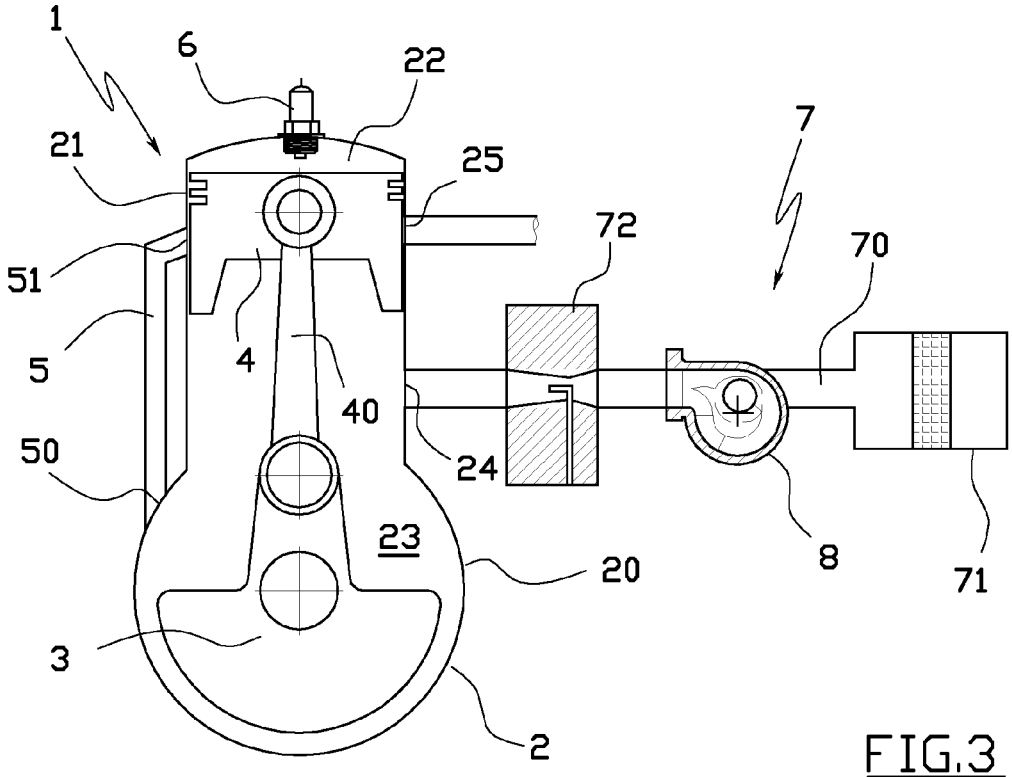
Figure 5:
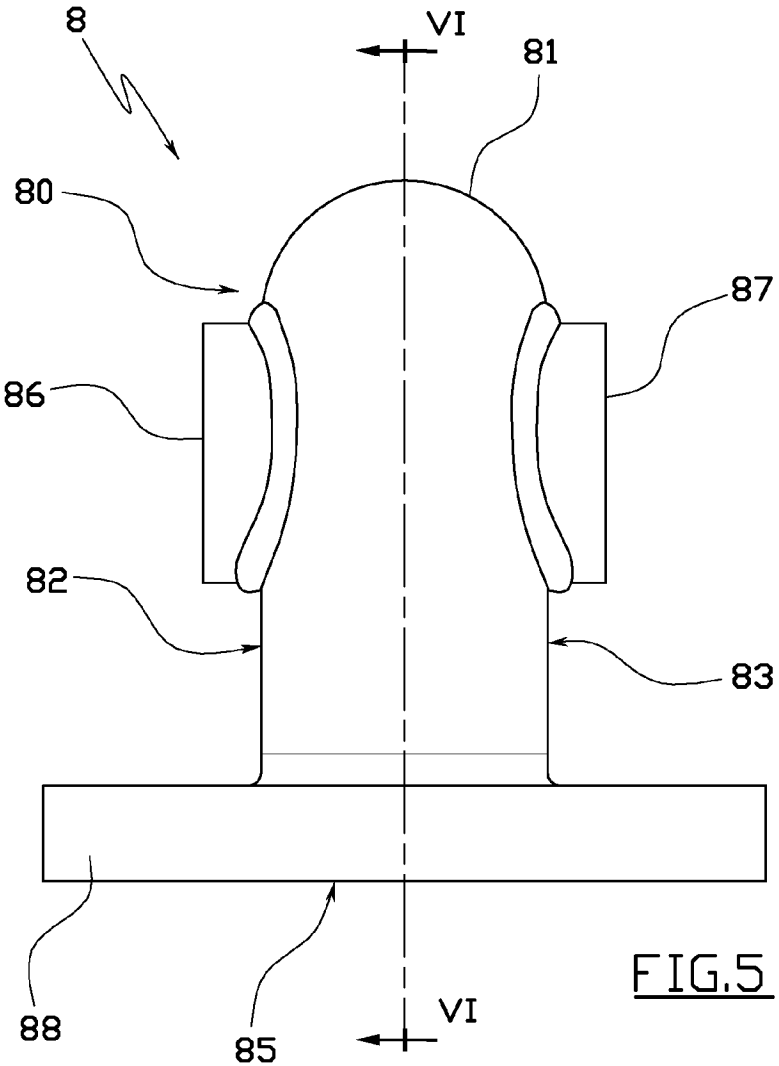
FIG. 5 is a plan view of the anti-backflow element illustrated in FIG. 4.
Figure 4:
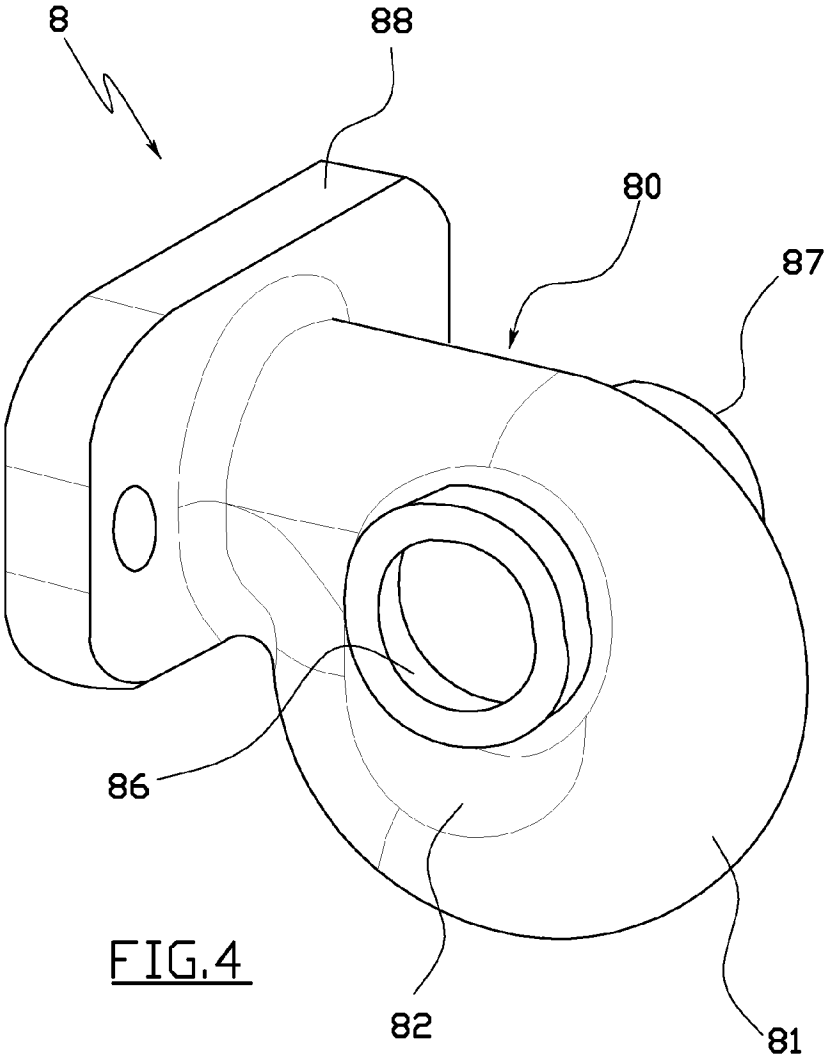
FIG. 4 is a prospective view of the anti-backflow element of the supply device of a first embodiment of the invention.

As illustrated in FIGS. 2 and 3, the piston 4 is shaped and scaled such that, when in proximity to the upper end of stroke position, where the volume of the combustion chamber 22 reaches minimum, the piston 4 closes the exhaust outlet 25 for combustion gases and the outlet 51 of the transfer duct 5, leaving open the inlet 24 which opens into the compression chamber 23. Conversely, when the piston 4 is in proximity to the lower end-of-stroke position, where the combustion chamber 22 reaches maximum volume, the piston 4 leaves open the exhaust outlet 25 for the combustion gasses and the outlet 51 of the transfer duct 5, closing the inlet 24. The inlet 50 of the transfer duct 5 always remains open.

The inlet 24 is connected to a device for the supply of air/fuel mixture, labelled globally as 7, the device schematically comprising a intake line 70 connecting the inlet 24 with the external environment, along which, installed in series, are an air filter 71 and a carburettor 72 wherein the air from the filter 71 is mixed with the petrol/oil mixture before entering the engine 1. The air filter 71 and the carburettor 72 are of known type in the engine sector and consequently are not described herein in greater detail.

The supply device 7 also comprises an anti-backflow element 8, which is also fitted in series on the intake line 70, between the air filter 71 and the carburettor 72.

It is important immediately to note that the intake line 70 here described schematically as a single duct should be considered in general as a system of one or more ducts serving to convey a flow of ambient air into the engine 1, transporting the air first through the filter 71, and then through the anti-backflow element 8, and finally through the carburettor 72.

As illustrated in FIGS. 4 to 7, the anti-backflow element 8 comprises an external casing, referenced globally as 80, preferably realized as a single body in metal material by a process of moulding.

The casing 80 comprises a perimetral band 81 of substantially circular transverse development (see FIG. 6), and two counterpositioned sides 82 and 83 serving to laterally close the perimetral band 81, such as to internally delimit a volute-shaped transit compartment 84 for the air/fuel mixture.

Figure 7:
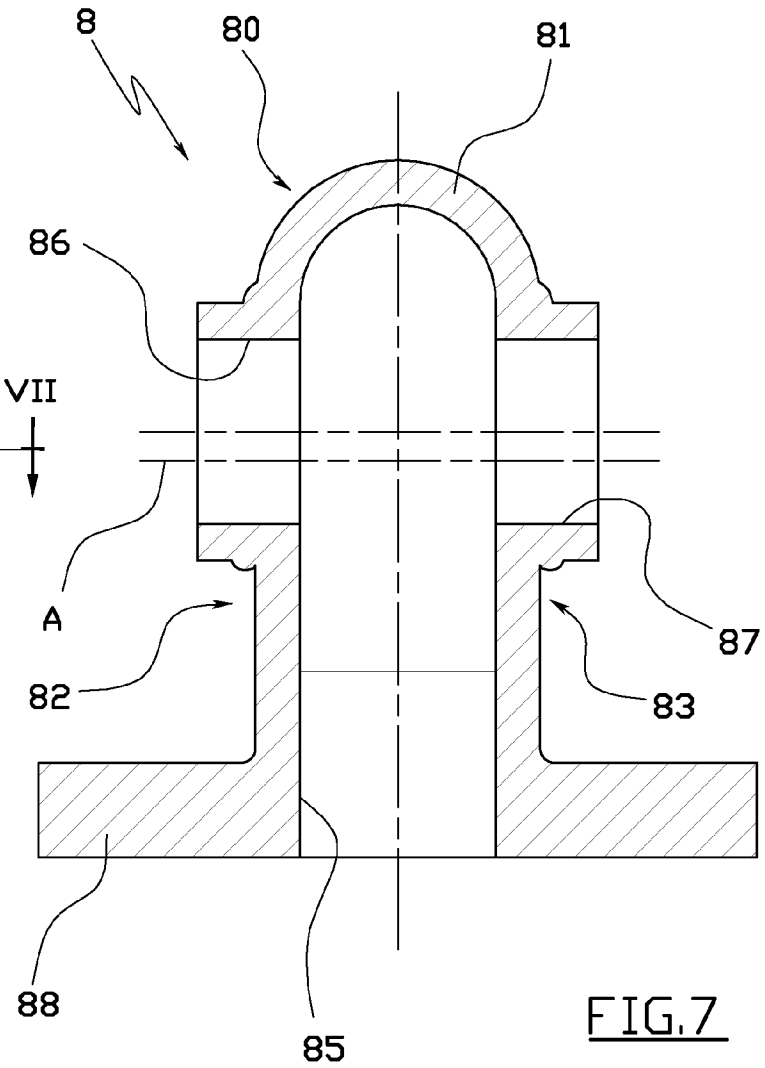
FIG. 7 is the cross-section of trace VII-VII indicated in FIG. 6.

In particular, the perimetral band 81 exhibits a rounded wall profile, illustrated in FIG. 7, and is connected to the side walls 82 and 83, such that the internal surfaces of the casing 80 are generally smooth and continuous, and essentially without corners.

The external casing 80, in the example illustrated, also comprises two inlet ducts to the transit compartment 84, and an outlet duct.

The outlet duct 85 opens in the perimetral band 81, the axis of the outlet duct 85 lying substantially perpendicular to the axis of curvature A of the perimetral band 81. The duct 85 is of smaller diameter than the diameter of the perimetral band 81, and is delimited by a cylindrical side wall exhibiting a generatrix tangential to the perimetral band 81 (see FIGS. 4 and 6). In this way, the duct 85 is aligned tangentially relative to the perimetral band 81, and serves to convey a flowing mass in a substantially tangential direction relative to the perimetral band 81. The free end of the duct 85 exhibits a flange 88 serving for the attachment of the anti-backflow element 8 to the carburettor 72 or in general to any other component of the intake line 70.

A first inlet duct 86 opens in the side wall 82 of the external casing 80, extending axially for a relatively short distance. The first inlet duct 86 is of comparable diameter, although slightly inferior, to the diameter of the duct 85, the axis of the first inlet duct 86 developing substantially perpendicular to the axis of the duct 85, or substantially parallel to the axis of curvature A of the perimetral band 81.

Figure 6:
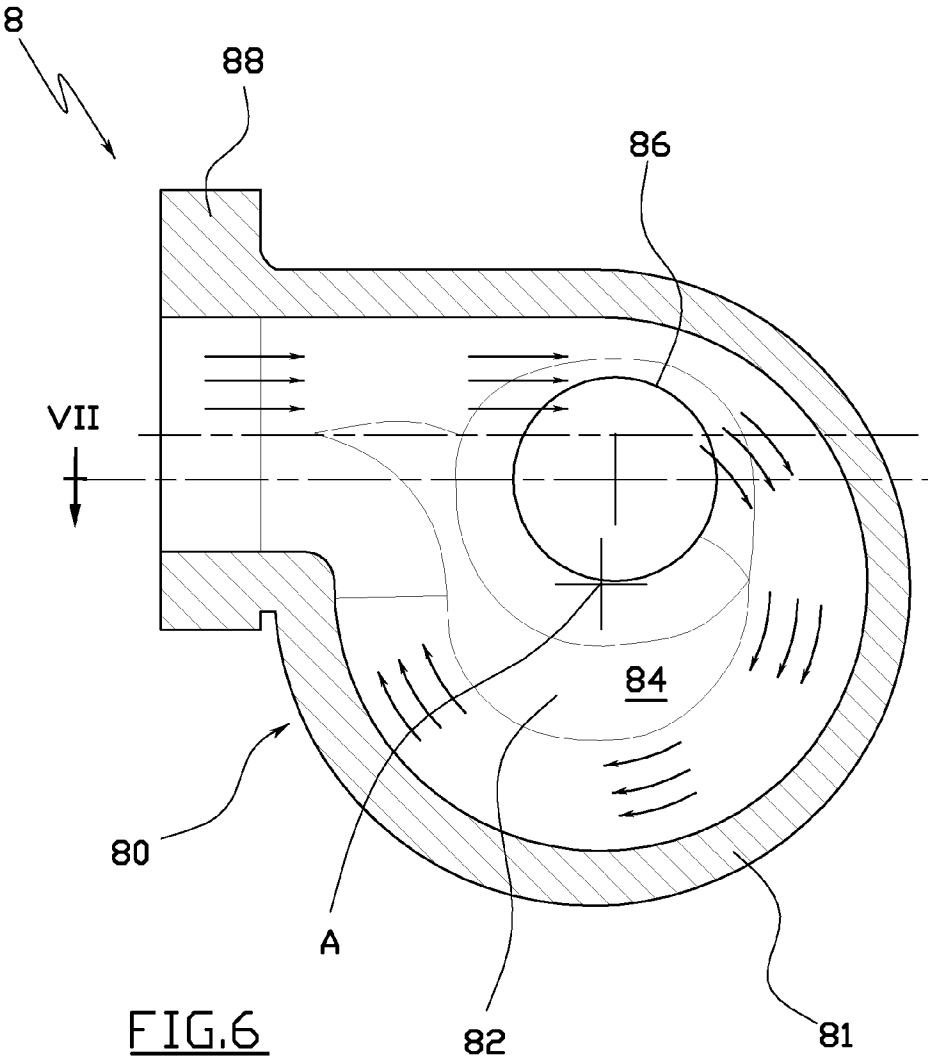
FIG. 6 is the cross-section of trace VI-VI indicated in FIG. 5.

As illustrated in FIG. 6, the first inlet duct 86 opens into the casing 80 through an opening that is eccentric in relation to the axis of curvature A of the perimetral band 81.

A second inlet duct 87 opens on the opposite side wall 83 of the casing 80 identical to the first inlet duct 86, relative to which the second inlet duct 87 is perfectly aligned and counterpositioned.

Consequently, all the ducts 85-87 are eccentric relative to the axis of curvature A of the perimetral band 81, such that a wide portion of the perimetral band 81 is laterally closed forming a beaker.

As illustrated in FIG. 1, the anti-backflow element 8 is installed in the supply device 7, such that the transit compartment 84 defined by the casing 80 is in communication with the carburettor 72 through the duct 85, and such that the transit compartment 84 is in communication with the air filter 71 through the first and second inlets 86 and 87.

In particular, the anti-backflow element 8 can be connected to the air filter 71 through a pair of ducts (not illustrated) connecting the air filter casing 71 with the first and second inlets 86 and 87 respectively; or the anti-backflow element 8 can be directly integrated into the air filter 71, such that the first and second inlets 86 and 87 open directly into the air filter casing, and only the duct 85 opens externally for connection to the carburettor 72.

It is specifically noted that, while two inlets, 86 and 87, are described in the example, both serving to create communication between the anti-backflow element 8 and the air filter 71, in general it is sufficient that the anti-backflow element 8 is provided with at least one of these inlets.

As illustrated in FIG. 1, the anti-backflow element 8 is assembled with the other components of the supply device 7 and mounted on the engine 1, such that when the engine 1 is in its normal operating position, the anti-backflow element 8 is oriented with the axis of curvature A of the perimetral band 81 substantially horizontal, this being at right angles to the direction of the force of gravity (indicated with the arrow G), and the openings of ducts 85, 86, and 87 are in a raised position relative to the axis of curvature A.

Thereby, during normal operation of the engine 1, the beaker portion of the casing 80 is facing downwards, defining the bottom of the transit compartment 84.

In should be noted that the normal operating position of the engine 1 is the position assumed by the engine during normal use of the power tool to which it is associated. If for example the engine 1 is installed on a mower or on a motor hoe, the normal operating position is the position of the engine 1 when the mower or motor hoe is advancing over the ground. If the engine 1 is installed on a portable blower, a chainsaw, or a bush cutter, the normal operating position is the position of the engine 1 when the tool is maneuvered by the user.

During the intake stage, the fluid air/fuel mixture in the intake line 70 is accelerated towards the engine 1 and sucked into the compression chamber 23 inside the engine compartment 20. For this reason, when during the subsequent down stroke the piston 4 closes the inlet 24, the fluid mixture previously accelerated is blocked by the piston 4 (see FIG. 2) and, as a consequence of inertia, generates a reverse pressure wave and a inverse flow of the air/fuel mixture down the intake line 70 from the engine 1 towards the air filter 71.

During this reverse movement, the inverse flow of air/fuel mixture passes through the carburettor 72 and enters the anti-backflow element 8 through the duct 85, where the tangential flow is directed against the perimetral band of circular development 81 of the outer casing 80.

Consequently, inside the transit compartment 84 of the anti-backflow element 8 a vortexual motion of the flow of air/fuel mixture is established (indicated with the arrows in FIG. 6), developing substantially along a plane orthogonal to the axis of curvature A of the perimetral band 81. This vortexual motion tends to deviate the inverse flow of air/fuel mixture back towards the carburettor 72, preventing the drops of fuel in the air/fuel mixture from reaching the air filter 71, thereby protecting the filter screens from possible damage and the formation of deposits, which rapidly and drastically reduce the filter capacity.

Further, the vortexual motion of the air/fuel mixture inside casing 80 tends to project the drops of fuel radially against the internal surfaces of the perimetral band 81, thereby separating the drops of fuel from the air and causing the fuel drops to accumulate by gravity on the bottom of the transit compartment 84.

As described above, the installation position of the anti-backflow element 8 on the engine 1 (see FIG. 1) is such that the base of the transit compartment 84 is normally defined by the beaker shaped portion of the casing 80, while the ducts 85-87 are located at a raised height relative to the axis of curvature A of the perimetral band 81.

Fuel that accumulates inside the anti-backflow element 8 is transported into the engine during the subsequent intake phase. The specific shape of the anti-backflow element 8 causes the air passing through the casing 80 from the filter 71 towards the carburettor 72 to acquire the fuel accumulated in the transit compartment 84 and carry the fuel with it towards the engine 1. It is important to note that this elimination of accumulated fuel is encouraged by the continuous smooth internal surfaces of the casing 80, thereby not hindering the free flow of fuel and not affording corners in which fuel might remain trapped.

Any excessive accumulations of fuel in the anti-backflow element 8 can also be released through a suitable valve (not illustrated) associated to the external casing 80.

In conclusion, it should be noted that, since the first and second inlets 86 and 87 are oriented parallel to the axis of curvature A of the perimetral band 81, the inlets 86 and 87 are substantially orthogonal to the plane along which the vortexual motion develops, reducing the probability that drops of fuel might be projected into the inlets 86 and 87 thereby reaching the air filter 71.

The inverse flow of air/fuel mixture passes in front of the first and second ducts 86 and 87 before being deviated by the perimetral band 81, this being when the kinetic energy of the fuel drops contained in the air/fuel mixture is still high and the drops tend to continue in a rectilinear direction, parallel to the axis of duct 85.

Figure 9:
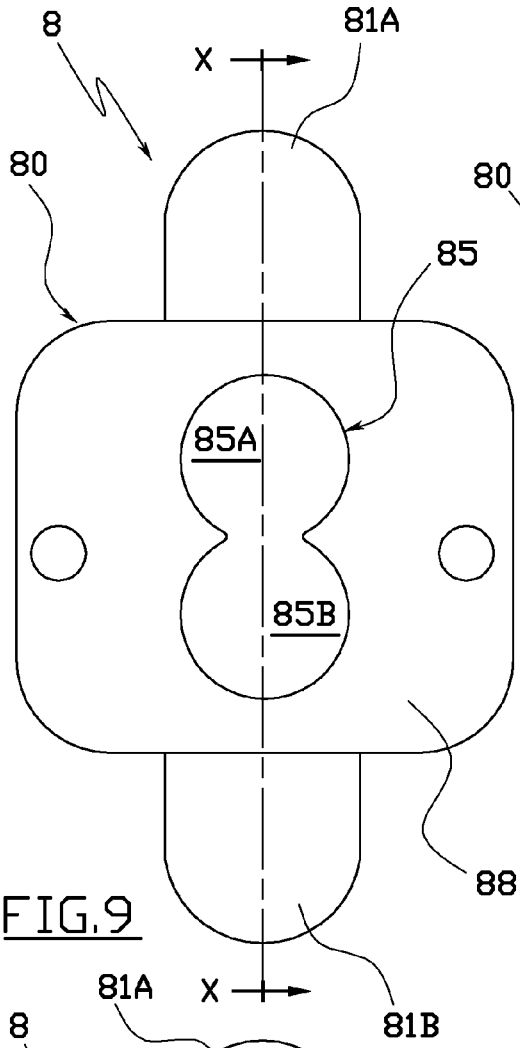
FIG. 9 is an orthogonal view of FIG. 8.
Figure 10:
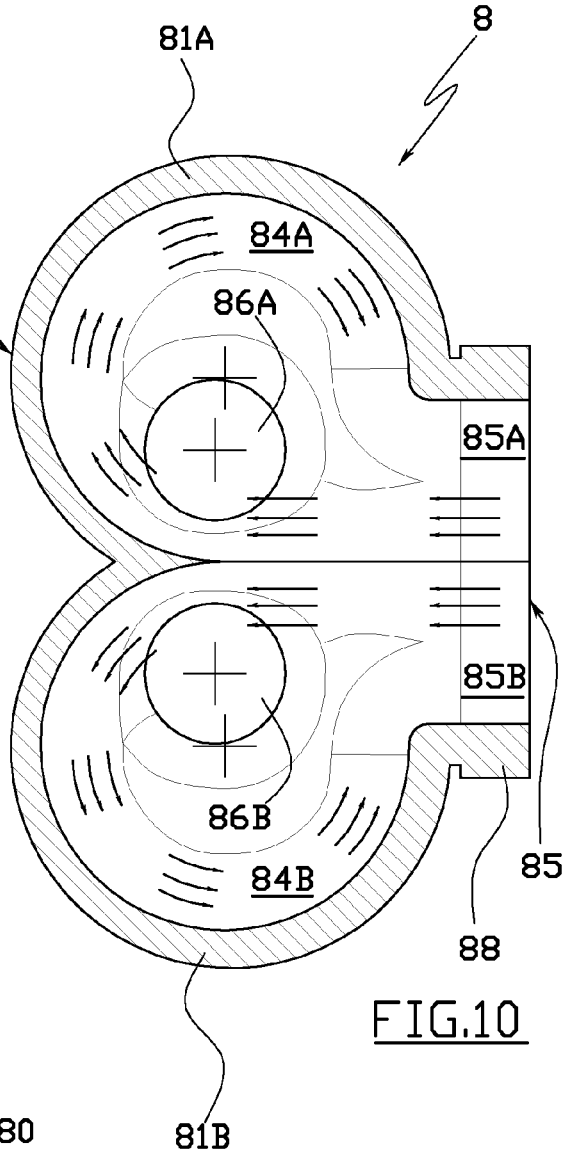
FIG. 10 is the cross-section X-X of FIG. 9.
Figure 8:
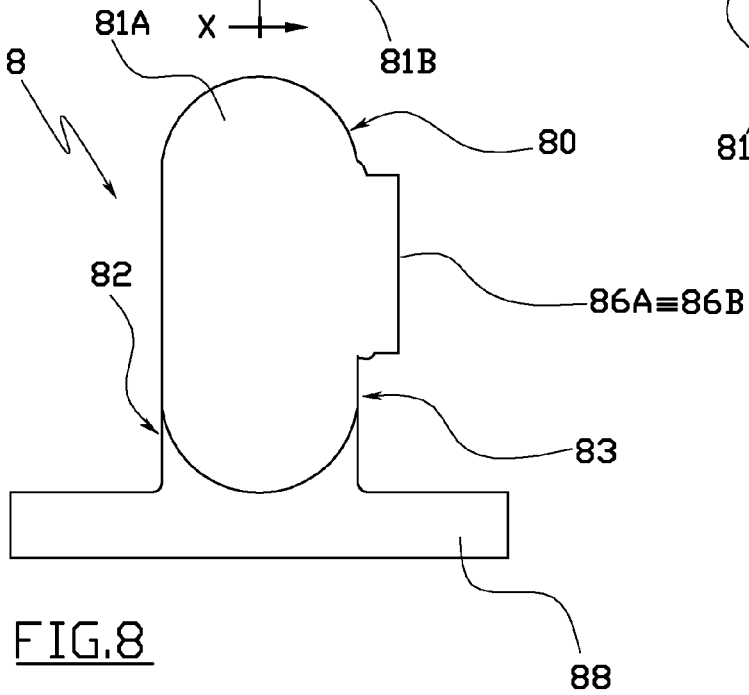
FIG. 8 is a plan view of an anti-backflow element in an alternative embodiment of the invention.

FIGS. 8 to 10 illustrate an anti-backflow element 8 in an alternative embodiment of the invention.

As illustrated in FIG. 10, the anti-backflow element 8 comprises an external casing 80 formed in a single body of metal material, the perimetral band thereof exhibiting two portions of circular development, respectively 81A and 81B, arranged symmetrically relative to the central axis of symmetry, conferring the perimetral band a generally two-lobed profile.

The two-lobed profile perimetral band is closed by side walls 82 and 83, thereby internally delimiting two spiral shaped compartments, 84A and 84B respectively, for the transit of the air/fuel mixture.

Again in this case, the wall of the perimetral band is rounded and connects with the side walls 82 and 83, such that the internal surfaces of the casing 80 are substantially free of corners.

The external casing 80 comprises two inlets 86A and 86B, both formed in the side wall 83 and individually creating communication between each of the respective internal compartments 84A and 84B and the air filter 71.

The inlets 86A and 86B are arranged symmetrically relative to the central axis of symmetry of the perimetral band, exhibiting axes parallel to the axes of curvature of the relative circular portions 81A and 81B.

In particular, each inlet 86A and 86B opens into the casing 80 through an opening eccentric relative to the axis of curvature of the relative circular portion 81A and 81B.

The casing 80 further comprises a single central outlet 85 opening in the perimetral band and developing along the axis of symmetry, thereby creating communication between both the internal compartments 84A and 84B and the carburettor 72.

As illustrated in FIG. 9, the duct 85 exhibits a two-lobed transverse cross-section, comprising two extended portions 85A and 85B each facing a respective circular portion 81A and 81B of the perimetral band 81, and reciprocally connected by a central narrowing located on the axis of symmetry.

Consequently, each extended portion 85A and 85B serves to convey a portion of the air/fuel mixture in a direction substantially tangential to the relative circular portion 81A and 81B of the perimetral band.

The free end of the duct 85 exhibits a flange 88 serving for the fixing of the anti-backflow element 8 to the carburettor 72 or in general to any other component of the intake line 70.

The anti-backflow element 8 of the second embodiment of the invention is installed in the supply device 7 in the same way as the first embodiment, wherein the transit chambers 84A and 84B are in communication with the carburettor 72 through the duct 85, and with the air filter 71 through the respective inlet ducts 86A and 86B, which can open directly into the filter casing.

Again in this case it is preferable that the anti-backflow element 8 is mounted such that when the engine 1 is in normal operating position, the axes of curvature of the circular portions 81A and 81B of the perimetral band 81 are substantially horizontal.

When there is a reverse flow the air/fuel mixture passes through the carburettor 72 and enters the anti-backflow element 8 through the duct 85, where half of the flow is directed tangentially against the circular portion 81A and the other half tangentially against the circular portion 81B.

In this way, inside each transit compartment 84A and 84B of the anti-backflow element 8 a vortexual motion is established (indicated with the arrows in FIG. 10), the vortexual motion developing substantially along a perpendicular plane to the axis of curvature of the relative circular portions 81A and 81B.

The two vortexual motions are counter rotating and tend to deviate the inverse flow of air/fuel mixture back towards the carburettor 72, preventing the drops of fuel contained in the air/fuel mixture from reaching the air filter 71.

The drops of fuel that separate from the air collect on the internal surfaces of the perimetral band 81 and by gravity at the bottom of the lower transit compartment 84B, from where the drops of fuel are redirected back towards the engine 1 during the subsequent intake phase.

An anti-backflow element of this second embodiment of the invention exhibits improved efficiency compared with the first embodiment described above, and reduced bulk.

Obviously a technical expert in the sector could introduce numerous modifications of a practical-technical nature to the backflow element 8 described above, without going outside of the range of the invention as claimed below.

The invention claimed is:

1. A device for supply of an internal combustion engine (1), comprising a carburettor (72) and an air filter (71) fitted on an intake line (70), through which intake line (70) air filtered by an air filter (71) is conveyed into a carburettor (72), and an anti-backflow element (8) located in series on the intake line (70) between the carburettor (72) and the air filter (71), wherein the anti-backflow element (8) exhibits an external casing (80) comprising a perimetral band (81) exhibiting at least a portion of substantially circular development closed by two side walls (82, 83), such as to internally define at least a compartment (84), which has an invariable geometry and which is in communication with the carburettor (72) through a duct (85) opening in the perimetral band (81) and extending tangentially relative to the portion of circular development; the compartment (84) also being in communication with the air filter (71) through at least a first duct (86) opening in one of the two side walls (82, 83).

2. The device of claim 1, characterized in that the first duct (86) is oriented parallel to the axis of curvature (A) of the at least a portion of substantially circular development of the perimetral band (81) of the external casing (80).

3. The device of claim 1, characterized in that the first duct (86) opens inside the casing (80) in an eccentric position relative to the axis of curvature (A) of the at least a portion of substantially circular development of the perimetral band (81), thereby defining a spiral.

4. The device of claim 1, characterized in that the at least a compartment defined by the external casing (80) is additionally in communication with the air filter (71) through a second duct (87) opening in the side wall (83) opposite to the side wall (82) in which the first duct (86) opens.

5. The device of claim 4, characterized in that the second duct (87) is identical to, and aligned with, the first duct (86).

6. The device of claim 1, characterized in that the perimetral band of the external casing (80) includes two portions (81A, 81B) of substantially circular development, arranged symmetrically relative to a central axis of symmetry, and closed by the side walls (82, 83) such as to define two internal compartments (84A, 84B), each of the internal compartments (84A, 84B) being in communication with the carburettor (72) through a duct (85) opening in the perimetral band and extending tangentially relative to the respective portion of circular development (81A, 81B), and the two internal compartments (84A, 84B) being in communication with the air filter (71) through at least a duct (86) opening in one of the side walls (83).

7. The device of claim 6, characterized in that the internal compartments (84A, 85B) are in communication with the carburettor (72) through a single duct (85) developing along the axis of symmetry of the perimetral band.

8. The device of claim 7, characterized in that the single duct (85) exhibits a two-lobed transverse cross-section, comprising two extended portions (85A, 85B) individually facing a relative circular portion (81A, 81B) of the perimetral band, and connected by a central narrowing at an axis of symmetry thereof.

9. The device of claim 1, characterized in that the perimetral band (81) exhibits rounded walls in transverse profile and is connected to the side walls (82, 83).

10. The device of claim 1, characterized in that the anti-backflow element (8) is integrated in the air filter (71), such that the at least a first duct (86) opens directly inside the filter casing (71).

11. An internal combustion engine characterized in that it comprises a supply device (7) of claim 1.

12. The engine of claim 11, characterized in that the supply device is fitted such that when the engine is in normal operating position, the anti-backflow element (8) is aligned with the axis of curvature (A) of the at least a portion of substantially circular development of the substantially horizontal perimetral band (81), and the first duct (86) is located in a raised position relative to the axis of curvature (A).

* * * * *